US008069861B2

(12) United States Patent
Sinclair, Jr.

(10) Patent No.: US 8,069,861 B2
(45) Date of Patent: Dec. 6, 2011

(54) METHOD AND APPARATUS FOR PREPARING A FINISHED TOBACCO PRODUCT INCLUDING SPECIAL FORM CASINGS AND SHEET CONFIGURATIONS

(76) Inventor: Daniel S. Sinclair, Jr., Mandeville, LA (US)

( * ) Notice: Subject to any disclaimer, the term of this patent is extended or adjusted under 35 U.S.C. 154(b) by 566 days.

(21) Appl. No.: 11/950,547

(22) Filed: Dec. 5, 2007

(65) Prior Publication Data

US 2008/0142025 A1 Jun. 19, 2008

Related U.S. Application Data

(60) Provisional application No. 60/870,490, filed on Dec. 18, 2006.

(51) Int. Cl.
*A24F 1/10* (2006.01)

(52) U.S. Cl. ..... 131/330; 131/347; 131/365

(58) Field of Classification Search ..... 131/360, 131/329, 347, 330, 365
See application file for complete search history.

(56) References Cited

U.S. PATENT DOCUMENTS

| | | | | |
|---|---|---|---|---|
| 725,671 | A * | 4/1903 | Butler | 131/360 |
| 3,204,643 | A * | 9/1965 | Redford | 131/187 |
| 6,053,175 | A * | 4/2000 | D'Angelo | 131/300 |
| 6,164,443 | A * | 12/2000 | Mitchell et al. | 206/242 |
| 6,403,144 | B1 * | 6/2002 | El-Khoury et al. | 426/662 |
| 7,712,472 | B2 * | 5/2010 | Kang et al. | 131/365 |
| 2002/0166561 | A1 * | 11/2002 | Sinclair, Jr. | 131/73 |
| 2003/0159406 | A1 * | 8/2003 | Roscoe | 53/444 |
| 2005/0072437 | A1 * | 4/2005 | Gomez | 131/329 |
| 2005/0072439 | A1 * | 4/2005 | Darwish | 131/347 |

OTHER PUBLICATIONS

Webster's Online Dictionary—entry for the word "TEND", http://www.merriam-webster.com/dictionary/tend, 3 pages printed from the Internet on Oct. 28, 2010.*

* cited by examiner

*Primary Examiner* — Richard Crispino
*Assistant Examiner* — Dionne Walls Mayes
(74) *Attorney, Agent, or Firm* — Garvey, Smith, Nehrbass & North, L.L.C.; Brett A. North

(57) ABSTRACT

A finished tobacco product is formed by a set of pre-rolled sheets. In one embodiment a form casing is used which includes at least two portions—a non-smokable portion along with a container portion which includes tobacco filler material.

13 Claims, 10 Drawing Sheets

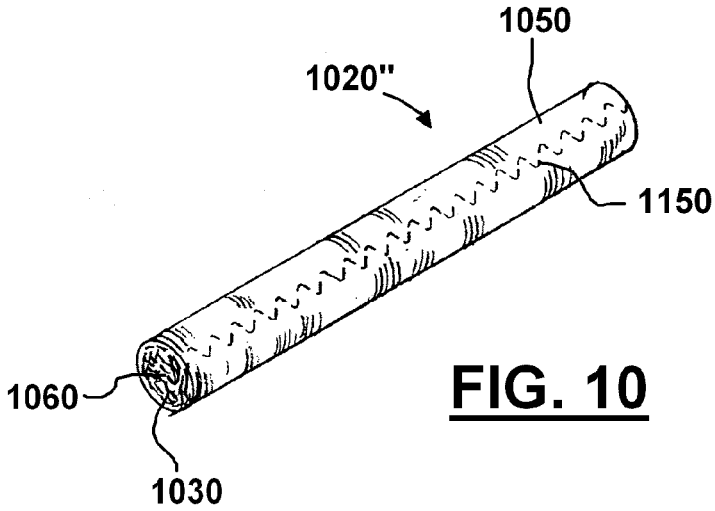
FIG. 10
FIG. 11
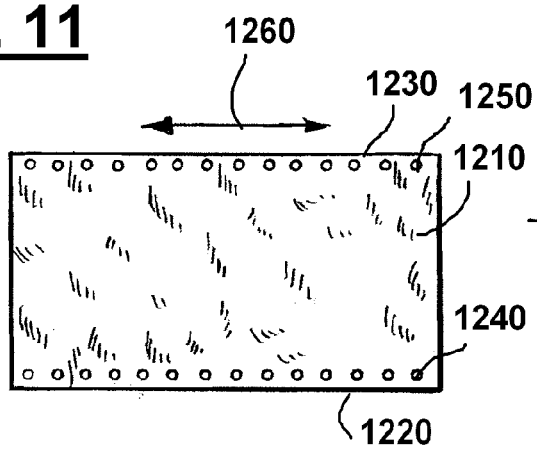
FIG. 12
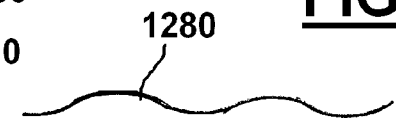
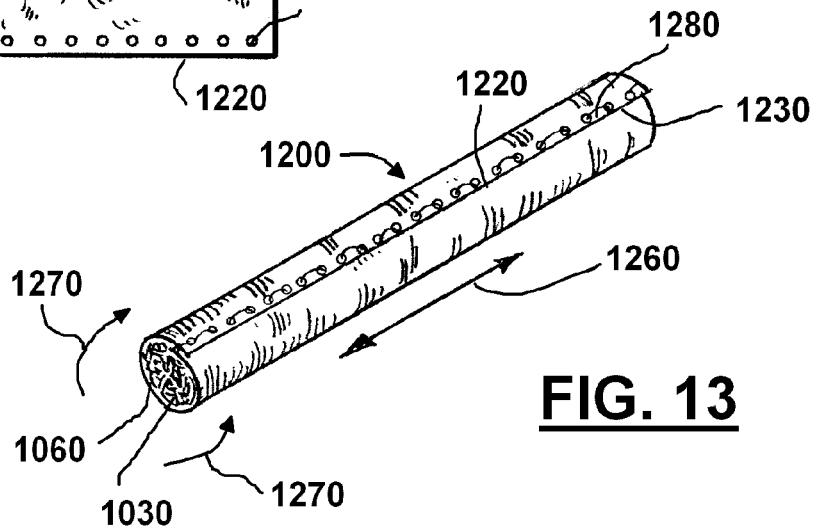
FIG. 13

METHOD AND APPARATUS FOR PREPARING A FINISHED TOBACCO PRODUCT INCLUDING SPECIAL FORM CASINGS AND SHEET CONFIGURATIONS

CROSS-REFERENCE TO RELATED APPLICATIONS

U.S. provisional patent application Ser. No. 60/870,490, filed Dec. 18, 2006, is incorporated herein by reference.

Priority of U.S. provisional patent application Ser. No. 60/870,490, filed Dec. 18, 2006, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to tobacco products, and more particularly to a cigar or shell enabling an end user or consumer to prepare a custom tobacco product. The variety, quality and size of ready-made cigars and/or cigarette satisfy the majority of the public. However, a small segment of connoisseurs insist that nothing can compare with the taste and smell of custom-blended tobacco products. These knowledgeable individuals are very selective in the manner their tobacco products are rolled and in the grade of tobacco used. A still smaller segment of aficionados prefers to roll their own tobacco products. They buy tobacco leaves or cigar wrappings and use their preferred brand of crushed tobacco. Some people buy inexpensive cigars, cut them with a sharp blade along the side, and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the "stuffing." The edges are then sealed with a liquid or honey, and a new cigar is ready for smoking.

Some reports indicate that the roll-your-own tobacco market is flourishing. In some countries, the roll-your-own products now hold a substantial share of the tobacco market, and their consumers represent more than 10% of the smoking population. This maybe explained by the ability of a consumer to create a tailor-made product, as opposed to commercially available types of tobacco products.

A disadvantage of the existing method of making such custom-made tobacco products is that a consumer has to be skillful in the rolling of tobacco products, that is to have a certain finger dexterity, which would allow him to make a tobacco product shell without crushing the item being used to make the tobacco product. Inexperienced people often become frustrated when the finished product collapses because the tobacco product was not properly rolled.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation maybe made without departing in any way from the spirit of the present invention. No feature of the invention is critical or essential unless it is expressly stated as being "critical" or "essential."

BRIEF SUMMARY

One embodiment provides pre-rolled sheets for fabricating and making custom made tobacco product, and a method of making such tobacco product that includes preferably tobacco, preferably tobacco leaves.

One embodiment provides various configurations of pre-rolled sheets. One embodiment includes a layered configuration of pre-rolled sheets including a first sheet of homogenized tobacco paper, a second sheet of natural leaf, and a third sheet of homogenized tobacco paper. One embodiment includes a layered configuration of pre-rolled sheets including a first sheet of natural leaf, a second sheet of homogenized tobacco paper, and a third sheet of natural leaf.

One embodiment includes a plurality of pre-rolled sheets numbering 2, 3, 4, 5, 6, 7, 8, 9, 10, 11, 12, 13, 14, 15, 16, 17, 18, 19, 20, 21, 22, 23, 24, 25, 26, 27, 28, 29, or 30. Various embodiments include possible ranges between any of the combinations of the above listed numbers. For example, between 3 and 20, 5 and 15, etc.

One embodiment includes sheets made of the same material, such as homogenized tobacco paper, natural leaf, rolling paper, and/or sheets of other smokable materials. One embodiment includes possible combinations of the different types of sheets of homogenized tobacco paper, natural leaf, rolling paper, and/or sheets of other smokable materials. One embodiment includes sheets comprised of different smokable materials chosen from any combination of the following types of materials: natural leaf, homogenized tobacco paper, pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa.

In one embodiment multiple types of filler material is included which offers the consumer the option of using different types of filler and/or blending between the types of filler included. In one embodiment different types of filler material can be chosen from any combination of the following types of filler material: pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa.

One embodiment provides various form casings which can support one or more pre-rolled sheets, which sheets can be used to make one or more finished tobacco products (e.g., cigars and/or cigarettes).

In various embodiments form casings can be comprised of one or more of the following materials or combinations of materials: filter material, sponge, cotton, paper, cardboard, wood, metal, tobacco, hemp, hemp paper, clove, mir, willow bark, dogwood cornus sp, red osier, pipsissewa, chimaphila, pyrola, kinnikinnik, arctostaphylos uva-ursi, camomile herbs, manzanita, shrubby arctostaphylos sp, madrone, arbutus menziesii, blackberry, rubus sp, scotch broom, cytisus, scoparius, cannabis, hemp THC-free, calamus, mullein, and/or verbascum thapsus. In various embodiments form casings can be comprised of sticks, tobacco sticks, and/or pipe cleaners.bark, In one embodiment filter material can be comprised of acetate, paper, plastic, polymer, cotton, charcoal, and/or a combination of one or more of the specified materials.

One embodiment provides form casing(s) which can include filler material at least partially contained by anon-smokable outer holder. In one embodiment, an outer portion of non-smokable material contains the tobacco filler and separates the filler from any pre-rolled sheets located around the form casings. In one embodiment the form casing supports the pre-rolled sheet(s) which can be contained inside the form casing with an outer layer of the form casing containing tobacco filler material.

One embodiment includes a first form casing which can support one or more pre-rolled sheets for forming one or more finished tobacco products (such as cigars and/or cigarette), along with a finished tobacco product, such as a finished cigar or cigarette which is packaged with the first form casing and the one or more pre-rolled sheets for forming finished tobacco products.

One embodiment includes a first form casing which can support multiple pre-rolled sheets for forming finished tobacco products, such as a finished cigar(s) or cigarette(s) which is packaged with the first form casing and the pre-rolled sheets for forming one or more finished tobacco products. One embodiment includes a layered configuration of pre-rolled sheets including a first sheet of homogenized tobacco paper, a second sheet of natural leaf, and a third sheet of homogenized tobacco paper. One embodiment includes a layered configuration of pre-rolled sheets including a first sheet of natural leaf, a second sheet of homogenized tobacco paper, and a third sheet of natural leaf. In other embodiments various possible permutations of these three types of pre-rolled sheets can be used.

One embodiment includes a first form casing which can support one or more pre-rolled sheets for forming finished tobacco products (such as cigars and/or cigarette), along with a quantity of tobacco product which can be used as tobacco filler for forming the finished tobacco products (such as cigars and/or cigarettes). In one embodiment the quantity of tobacco product is formed in a cylindrical shape around which at least one pre-rolled sheet can be wrapped to form a finished tobacco product. In one embodiment the quantity of tobacco product is itself wrapped with a wrapper that is separate from the one or more pre-rolled sheets. In one embodiment the quantity of tobacco product is contained in a box and packaged with the one or more pre-rolled sheets for forming finished tobacco product. In one embodiment, the tobacco product is loosely packaged with the first form casing and one or more pre-rolled sheets for forming finished tobacco products.

One embodiment provides form casings including moisturizing agents which can permeate and/or migrate from the form casing to the pre-rolled sheet(s).

One embodiment provides form casings including flavoring agents which can permeate and/or migrate from the form casing to the pre-rolled sheet(s).

One embodiment provides form casings including scenting agents which can permeate and/or migrate from the form casing to the pre-rolled sheet(s).

One embodiment includes a cigar tip which can be used with the finished tobacco products. One embodiment includes the a cigar tip attached to the at least one pre-rolled sheet before a sheet is formed into a finished cigar, such as when the at least one pre-rolled sheet is packaged for sale pre-rolled, but in an unfinished state.

The method of the present invention thus enables an end user to make his or her own custom finished tobacco products with a selected, custom filler material/blend of filler material. The method preferably includes the use of a liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry/kiwi, vanilla, watermelon, wet cherry, and/or whiskey.

The flavors are preferably added to the form casings and/or pre-rolled sheets with a liquid. This flavored liquid is typically applied at levels of between about 0.01 to 45% by weight, and preferably between about 0.1% to 10% by weight. This flavored liquid is typically applied to the at least one pre-rolled sheet with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

BRIEF DESCRIPTION OF THE DRAWINGS

Reference will now be made to the drawings, wherein like parts are designated by like numerals, and wherein:

FIG. 10 shows one embodiment of a non-smokable form casing storing tobacco filler material.

FIG. 11 shows one embodiment which can be used to make a non-smokable form casing storing tobacco filler material.

FIG. 12 shows a cord/thread/string/wire for the embodiment of FIG. 11.

FIG. 13 shows a non-smokable form casing formed from FIG. 11.

DETAILED DESCRIPTION OF AT LEAST ONE PREFERRED EMBODIMENT

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner. Reference will now be made to the drawings, wherein like parts are designated by like numerals.

Figure 1:
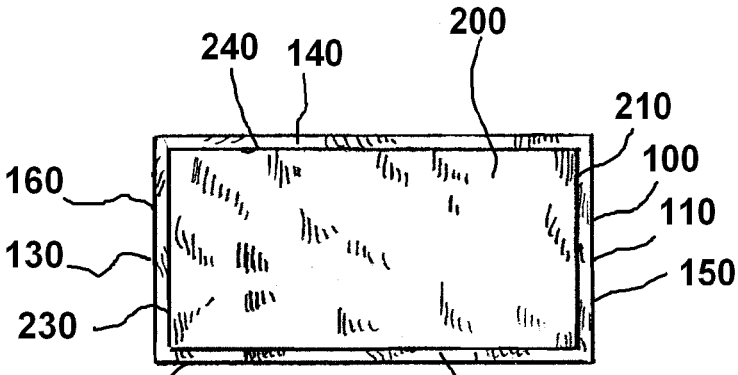
FIG. 1 shows two sheets which can be pre-rolled.
Figure 2:
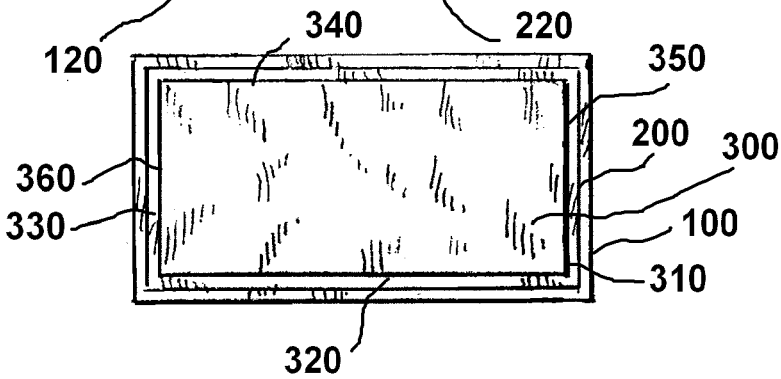
FIG. 2 shows three sheets which can be pre-rolled.

FIG. 1 shows two sheets 100, 200 which can be pre-rolled. FIG. 2 shows three sheets 100, 200, 300 which can be pre-rolled. Sheets 100, 200, 300 can be any form of smokable material which can form the wrapping of a finished cigar and/or finished cigarette. For example, the sheets can be comprised of natural leaf tobacco and/or homogenized tobacco paper. Alternatively, one or more of the sheets can be comprised of alternative smokable substances, such as non-tobacco paper, tea leaves, pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa, etc. In one embodiment any combination of the above referenced materials can be offered.

Sheet 100 can include edges 110, 120, 130, and 140. Sheet 100 is shown as being rectangular in shape. Alternatively, sheet 100 can be other shapes such as square, trapezoidal, or an irregular shape.

Sheet 200 can include edges 210, 220, 230, and 240. Sheet 200 is shown as being rectangular in shape. Alternatively, sheet 200 can be other shapes such as square, trapezoidal, or an irregular shape.

Sheet 300 can include edges 310, 320, 330, and 340. Sheet 300 is shown as being rectangular in shape. Alternatively, sheet 300 can be other shapes such as square, trapezoidal, or an irregular shape.

Sheets 100, 200, and 300 are shown as decreasing in size. Alternatively, these sheets can be the same size, or any combination of sizes. For example, sheet 2 can be larger than sheets 100 and 300.

Figure 3:
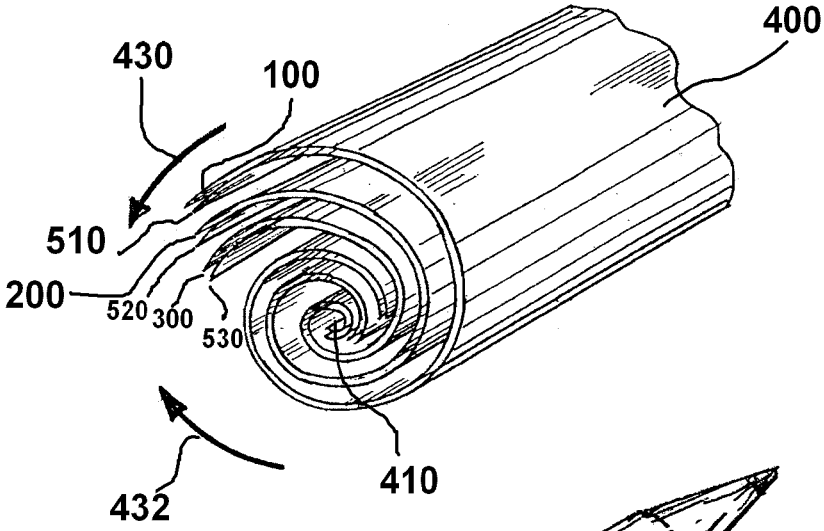
FIG. 3 is a perspective view of three pre-rolled sheets with three intermediate sheets.

Although only two and three sheets 100, 200, 300 are shown in FIGS. 1 through 3, in alternative embodiments 4, 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 55, 60, 65, 70, 80, 90, and 100 can be pre-rolled. Alternatively, ranges between any of these specified numbers or groups of specified numbers can be pre-rolled in one set. Alternatively, sister sets of pre-rolled sheets can be packaged together, such as one pre-rolled sheet on a first form casing next to a second pre-rolled sheet on a second form casing. The number of pre-rolled sheets on each form casing can vary between each set of the above referenced numbers. Additionally, they can vary between each range for each set of the above referenced numbers.

If desired sheets 100, 200, and 300 can include intermediate sheets which may assist in preventing the sticking together of one or all of the sheets. FIG. 3 shows three pre-rolled sheets 100, 200, 300 rolled with three intermediate sheets 510, 520, and 530. Intermediate sheets 510, 520, and 530 can be plastic, cellophane, polymer, metal, foil, wax paper, or other materials which tend not to stick and/or resist moisture and/or air flow. Multiple pre-rolled sheets 100, 200, 300 can be combined with multiple separating sheets 510, 520, 530. The multiple sheets 100,200,300 and separating sheets 510,520, 530 can be stacked in an alternating manner and rolled into at least one pre-rolled sheet 400. At least one pre-rolled sheet can then be encased in a wrapper/packaging. Alternatively, additional pre-rolled sheets (e.g., four or more) can be used forming multiple sheet rolled shell. Also alternatively, merely two sheets 100, 200 can be used forming multiple sheet rolled shell. Also alternatively, a smaller number of separating sheets 510, etc. can be used than the number of pre-rolled sheets 100, 200, 300. For example, in one embodiment only an outer separating sheet 510 is used with multiple pre-rolled sheets 100, 200, 300. As another example, only an inner separating sheet 530 is used with multiple pre-rolled sheets 100, 200, 300. As another example, alternating separating sheets 510, 530 are used with multiple pre-rolled sheets 100, 200, 300. Also alternatively, more separating sheets 510, 520, 530, etc. can be used than pre-rolled sheets 100, 200, 300. Additionally, more or less than three pre-rolled sheets 100, 200, 300 can be used. Alternatively, similar to the embodiments shown in FIGS. 4 and 7, separating sheets 510,520, and/or 530 can be used as the wrapper/packaging (either all separating sheets 510,520,530 or a subset of all separating sheets 510,520,530). Additionally, with any of these embodiments pre-rolled sheets 100,200,300 can include a form casing/mandrel 600 either on the inside or outside of the set of pre-rolled sheet(s). Form casing 600 can assist pre-rolled sheets in maintaining their shape after being packaged.

In another alternative embodiment, pre-rolled sheet 400 (e.g., sheet 100) and separating sheet 510 are first rolled into rolled shell and then pre-rolled sheet 400' (e.g., sheet 200) and separating sheet 520 are then rolled over the shell formed by pre-rolled sheet 400 to form a new rolled shell with pre-rolled sheet 400 and pre-rolled sheet 400'. Alternatively, multiple rolled shells can be formed in this manner with alternating pre-rolled sheets and separating sheets. The order of pre-rolled sheets and separating sheets can be varied, such as having inner pre-rolled sheets and outer separating sheets; or inner separating sheets and outer pre-rolled sheets. Alternatively, one or more separating sheets can be omitted from the set of pre-rolled sheet(s).

Figure 4:
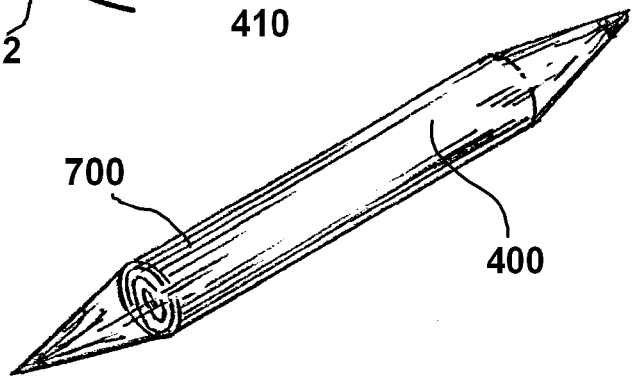
FIG. 4 shows one pre-rolled sheet which is individually packaged without a form casing.

FIG. 4 shows one pre-rolled sheet 400 which is individually packaged without a form casing. Additionally, sheet 400 is pre-rolled with an intermediate sheet and the intermediate sheet forms packaging 700. In this embodiment, intermediate sheet 700 is preferably larger than the pre-rolled sheet 400 so that it can encase the pre-rolled sheet 400.

Figure 5:
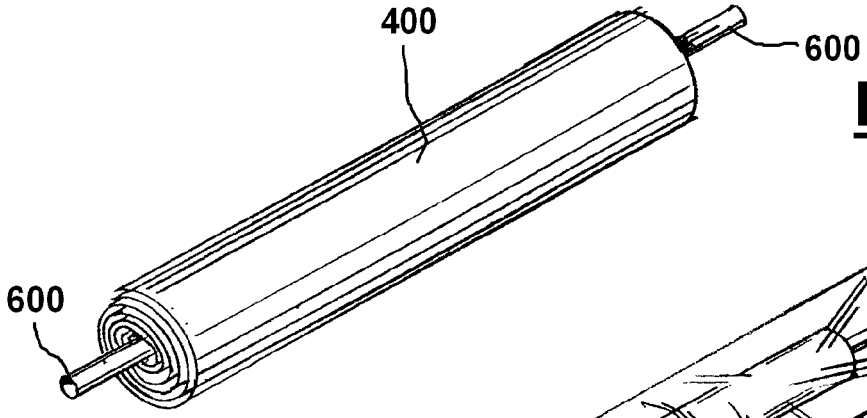
FIG. 5 shows multiple pre-rolled sheets on a form casing.

FIG. 5 shows multiple pre-rolled sheets 400 on a form casing 600. Form casing 600 is shown as being longer in a longitudinal direction than the length of pre-rolled sheets 400. Alternatively the length of form casing 600, in relation to the longitudinal length of pre-rolled sheet or sheets 400 can be at least as long as about (in percentages) 50, 55, 60, 65, 75, 80, 85, 90, 91, 92, 93, 94, 95, 96, 97, 98, 99, 100, 101, 102, 103, 104, 105, 106, 107, 108, 109, 110, 115, 120, 125, 130, 135, 140, 145, 150, 160, 170, 180, 190, and/or 200. Alternatively, the length of form casing be vary between any combination of the above specified percentages and/or ranges of the specified percentages.

Form casing/mandrel 600 is preferably formed from a rigid or flexible material in a form of a cylinder of a predetermined length and outer diameter. Form casing/mandrel 600 can be made either hollow, with a central opening, or as a solid body. It is desirable that form casing/mandrel 600 be substantially inflexible and strong enough to withstand forces applied to form casing/mandrel 600 when one or more sheets are pre-rolled on form casing/mandrel 600, when the unit is shipped to its ultimate selling outlet, and when one or more pre-rolled sheets are unrolled from form casing/mandrel 600.

In various embodiments form casing 600 can be comprised of one or more of the following materials or combinations of materials: filter material, sponge, cotton, paper, cardboard, wood, metal, tobacco, hemp, hemp paper, clove, mir, willow bark, dogwood cornus sp, red osier, pipsissewa, chimaphila, pyrola, kinnikinnik, arctostaphylos uva-ursi, camomile herbs, manzanita, shrubby arctostaphylos sp, madrone, arbutus menziesii, blackberry, rubus sp, scotch broom, cytisus, scoparius, cannabis, hemp THC-free, calamus, mullein, and/or verbascum thapsus. In various embodiments form casing 600 can be comprised of sticks, tobacco sticks, and/or pipe cleaners.bark, In one embodiment filter material can be comprised of acetate, paper, plastic, polymer, cotton, charcoal, and/or a combination of one or more of the specified materials.

In one embodiment, form casing 600 can include two layers (inside and outside layers). The layers can be comprised of an aluminum/polymer/non-smokable outside layer and tobacco filler inside layer.

Additionally, form casing can include a perforated section with a gel interior to allow the gel to gain access to the one or more pre-rolled sheets 400. This gel interior can be used for moisturizing, flavoring, and/or scenting the one or more pre-rolled sheets 400.

In one embodiment, the moisturizing, flavoring, and/or scenting item can be separated from the form casing but packaged together with the one or more pre-rolled sheets 400 which may or may not include a form casing 600. For example, one or more of the following can be included: gel in package, package or back, filter, pocket in packaging, loose tobacco in packaging.

Figure 6:
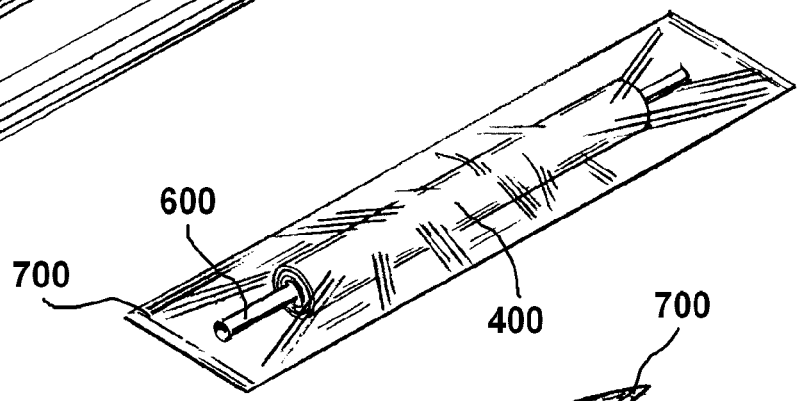
FIG. 6 shows a single pre-rolled sheet with a form casing which is packaged.
Figure 7:
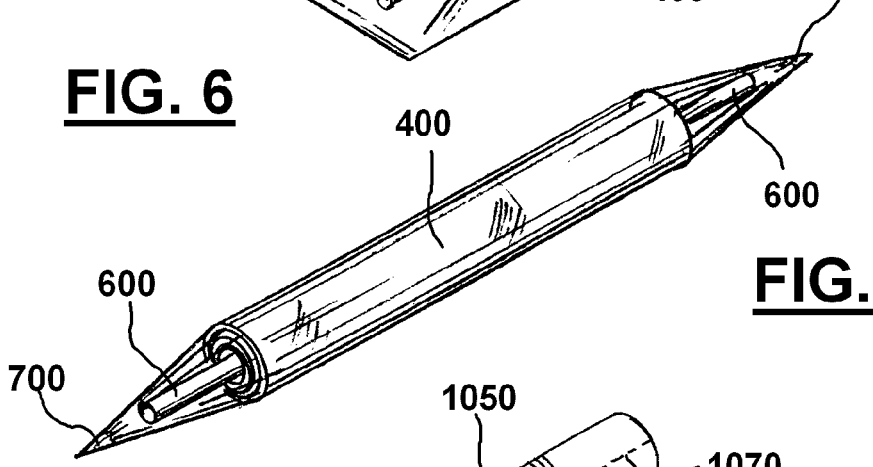
FIG. 7 shows a single pre-rolled sheet and intermediate sheet with a form casing where the intermediate sheet is also used as the packaging.

FIG. 6 shows a single pre-rolled sheet 400 with a form casing 600 which is packaged in packaging 700. FIG. 7 shows a single pre-rolled sheet 400 and intermediate sheet 700' with a form casing 600 where the intermediate sheet 700' is also used as the packaging 700. Any of the disclosed form casings in the application can be used interchangeably.

Figure 8:
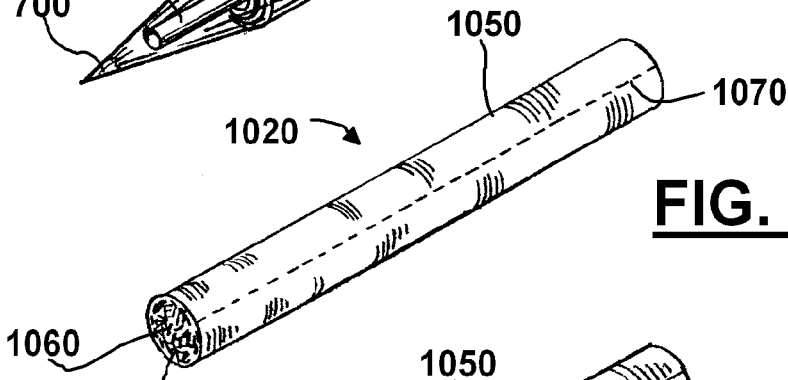
FIG. 8 shows one embodiment of a non-smokable form casing storing tobacco filler material.

FIG. 8 shows one embodiment of a non-smokable form casing 1020 storing tobacco filler material. Form casing 1020 can comprise sheet or layer 1050 which can contain tobacco filler material 1030 in its bore 1060. Perforations 1070 can be used to assist the consumer in opening form casing 1020 and using tobacco filler material 1030 to make a finished tobacco product with one or more sheets 400. Sheet or layer 1050 can comprise any non-smokable material capable of containing tobacco filler material. For example it can be filter material, sponge, cotton, cardboard, wood, metal, sticks, pipe cleaners, and/or other non-smokable materials.

Figure 9:
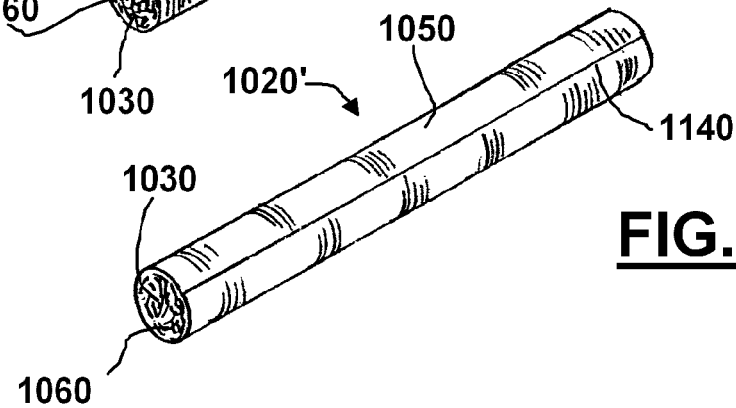
FIG. 9 shows one embodiment of a non-smokable form casing storing tobacco filler material.

FIG. 9 shows one embodiment of a non-smokable form casing 1020' storing tobacco filler material 1030. Form casing 1020' differs from form casing 1020 in that sheet 1050 can be rolled and layered where it is sealed along line 1140. To open form casing and use tobacco filler material 1030 in bore 1060 sheet 1050 is opened along line 1140.

FIG. 10 shows one embodiment of a non-smokable form casing 1020" storing tobacco filler material 1030. Form casing 1020" differs from form casing 1020 in that sheet 1050 can be opened via jagged perforations 1150.

FIG. 11 shows the embodiment of FIG. 8 or 9 where the form casing 1020 has been opened to access the tobacco filler material 1030. Removed tobacco filler material 1040 can be used with one or more pre-rolled sheets 400 to form a finished tobacco product.

FIG. 11 shows one embodiment of a non-smokable layer/section/sheet 1210 which can be used to make a non-smokable form 1200 casing storing tobacco filler material 1030. Edges 1220, 1230 of sheet 1210 respectively can include plurality of openings 1240, 1250 located next to the edges. When stitched together using cord/string/thread/tie 1280 of FIG. 12, non-smokable form casing 1200 can be formed containing tobacco filler material 1030 in its bore 1060. Bore 1060 can be filled with tobacco filler material 1030. Tie 1280 can be threaded through openings 1240, 1250 to hold form casing 1200 in a cylindrical shape. Alternatively openings 1240, 1250 can be formed after sheet 1210 has been rolled into a cylindrical shape and filled with tobacco filler material 1030. Openings 1240, 1250 can be formed at the same time tie 1280 is inserted into the openings, such as by stitching with a sewing machine. Tie 1280 is shown relatively loose but can be as tight as desired causing edges to touch. When a user desires to use the tobacco filler material 1030, tie 1280 can be cut or untied from openings 1240, 1250 and edges can be pulled apart providing access to bore 1060. Tobacco filler material 1030 can be removed from bore 1060 and used to fill one or more pre-rolled sheets 400 with their memory wherein the one or more pre-rolled sheets 400 will tend to roll up in the directions of arrows 430, 432 allowing the user to easily make a finished tobacco product.

Figure 14:
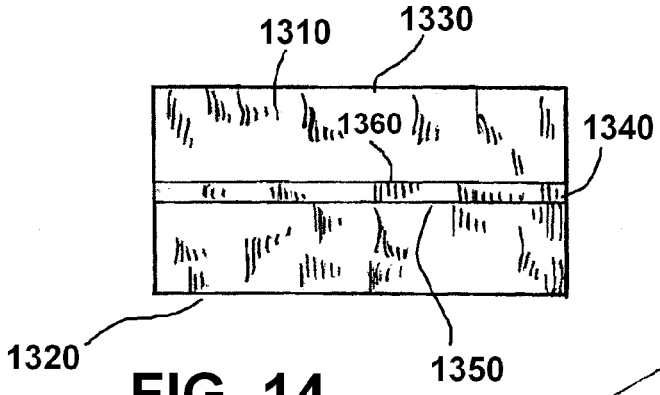
FIGS. 14 and 15 show one embodiment for a non-smokable form casing storing tobacco filler material.
Figure 15:
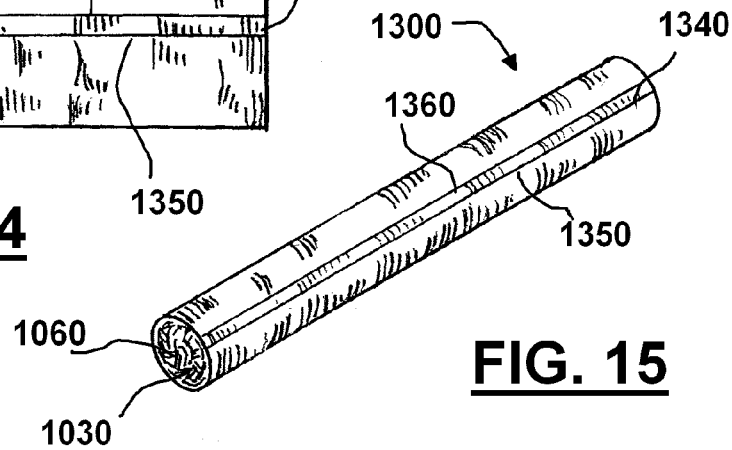

FIGS. 14 and 15 show one embodiment for a non-smokable form casing 1300 storing tobacco filler material 1030 in its bore 1060. In this embodiment a sheet 1310 is used having area 1340 of weaker structural integrity. When formed into form casing 1300, tobacco filler material 1030 (in bore 1060) can be accessed by opening form casing 1300 along weaker area 1300 which can be easily separated when desired. Area 1300 can be formed by causing it to be of less thickness than the remaining portion of sheet 1310. Various processes can be applied to area 1340 to make it weaker than the remainder of sheet 1310—such as scarring, scratching, etching etc. Where stress is applied to area 1340 of sheet 1310 will separate along area 1340 and two edges. Selected tobacco filler material 1030 can then be used with one or more pre-rolled sheets 400 to form a finished tobacco product.

To use one ore more pre-rolled sheets 400, the user merely unwraps the one or more pre-rolled sheets 400 and fills one or more of these sheets with the user's tobacco filler of choice. If form casing 600 was used it is removed. If form casing 600 included tobacco filler material, such material can be used to make the custom tobacco product. Because the one or more sheets are pre-rolled when unwrapped they will tend to have a "roll back memory" which will assist in rolling a finished tobacco product. Each sheet will have this memory which will cause it to tend to roll back up on its own. Thus the user will have an easier time in creating a custom finished tobacco product (e.g., cigars and/or cigarette) and will not need finger dexterity as required with flat sheets.

One or more intermediate sheets 510, 520, and/or 530 can be used to substantially increase the shelf life of packaged set of pre-rolled sheet(s) 400. Because at least one pre-rolled sheet 400 can be made of tobacco, when exposed to it will tend to dry out and become brittle. Intermediate sheets 510, 520, and/or 530 being wrapped between and/or around at least one pre-rolled sheet 400 provides multiple layers of protection against air flow and consequent moisture loss.

The at least one pre-rolled sheet(s) 400 can be packaged in conventional containers and sold directly to customers who desire to roll their own tobacco products, but do not have the required finger dexterity. An ultimate user will remove the at least one pre-rolled sheet 400 from its outer packaging, then prying the at least one pre-rolled sheet 400 open by forcing it open. Because the at least one pre-rolled sheet 400 is pre-rolled, it has a "roll back memory" and will attempt to again assume a cylindrical or spiral shape. The user will then fill the at least one pre-rolled sheet(s) 400 with any desired blend of his favorite tobacco and seal its edges by applying a small amount of moisture to the edges, and then bringing the edges together. A small amount of pressure may be applied to the edges to cause them to seal together. If more than one pre-rolled sheet is 400 contained, the user has the choice of rolling the finished tobacco product with one or more than one sheet (e.g., 100, 200, 300, and/or etc.). Alternatively, the user can use each sheet to make individual custom made tobacco products. In this manner, a custom-tailored tobacco product(s) (e.g., cigar(s) and/or cigarette(s)) is made, answering all requirements of a connoisseur regarding blend, layer configuration, size, and/or length.

In one embodiment, the user may use more than one pre-rolled sheet to decrease the burn rate of the finished tobacco product. It is believed that the burn rate decreases when the amount of sheets are increased.

Alternatively, the at least one pre-rolled sheet(s) 400 can include multiple sheets of differing flavors and/or scents. In this manner the user can determine the flavor and/or scent of the finished tobacco product.

In FIGS. 1 through 3, at least one pre-rolled sheet 400 can be, for example, generally rectangular or square in shape. Other shapes for at least one pre-rolled sheet 400 can be provided such as, for example, triangular, trapezoidal, circular, or oval. At least one pre-rolled sheet 400 preferably includes tobacco, and preferably tobacco leaves. Alternatively, at least one sheet can omit tobacco altogether as long at the materials forming the sheet are smokable. At least one pre-rolled sheet 400 preferably comprises a laminated composite of two layers, one inner layer preferably made of homogenized tobacco material and the other outer layer preferably made of tobacco leaf material, inner layer and outer layer preferably bonded together with cigar glue. Preferably, the outer layer extends beyond the inner layer to provide for better adhesion of edges when rolled. The homogenized tobacco material of inner layer can be reconstituted tobacco sheet material commercially available from Nuway of Connecticut. Outside layer can be tobacco leaf material commercially available from Nuway of Connecticut. Alternatively, one or more of the sheets can be natural tobacco leaf. Alternatively, one or more of the sheets can be other smokable materials.

Alternatively, inner layer can be reconstituted tobacco binder material, and outer layer can be reconstituted tobacco wrapper material. In the alternative, inner layer can be reconstituted tobacco binder material, and outer layer can be tobacco leaves bonded thereto. At least one pre-rolled sheet 400 can be a single layer, in which case it is preferably made of tobacco leaf material, though it can be made of homogenized tobacco material or other smokable material.

As part of the method, the at least one pre-rolled sheet 400 can be sprayed with a liquid that preferably includes a flavoring.

At least one pre-rolled sheet(s) 400 can be packaged in any appropriate manner. For example, they can be individually packaged in a pouch, bag, or box. In one embodiment multiple sets of pre-rolled sheets 400, 400', etc. can be packaged in a single zip-wrapper where the multiple sets are together pouched, bagged, or boxed. Alternatively, the individual sets can be pouched, bagged, or boxed. Units can be packaged in a zip-wrapper and the zip wrapper can be enclosed in a box. The box itself can be covered by a wrapper and include a window for viewing the contents.

In one embodiment, multiple sets of pre-rolled sheets 400, 400', 400", etc. can each be individually wrapped and placed in a single carton opening at the top through a lid. The multiple sets of pre-rolled sheets can each be individually packaged in wrappers and such wrappers can have indicia which provides consumers with information concerning the sets of pre-rolled sheets, such as flavoring, scent, moisture, or other information. The carton can itself be covered by wrapper.

Those skilled in the art will understand that various materials for wrapping can be used to enclosed the sets of at least one pre-rolled sheet(s) 400. These include, but are not limited to, Low & High Density Polyethylene with EVA additive, Linear Low Density Poly, Polypropylene, Orientated Polypropylene, Cast Polypropylene, PVC, Polyester, Vaper Barrier packaging, Moisture Barrier packaging, Laminated packaging, Shrink film, Stretch Film, Foil Films (which can be translucent or opaque), Metalized Film, Cellophane, and Polyethylene Terephthalat. In addition to an "EVA" additive a barrier foil lamination can be used being either coated or metallized. The packaging, whether plastic, aluminum, or glass, keeps moisture in or dramatically slows down moisture loss from the sets of pre-rolled sheet(s). It is preferable that the wrapping material have adequate moisture resistant properties so that the set of pre-rolled sheet(s) does not dry out before use by consumers.

Figure 16:
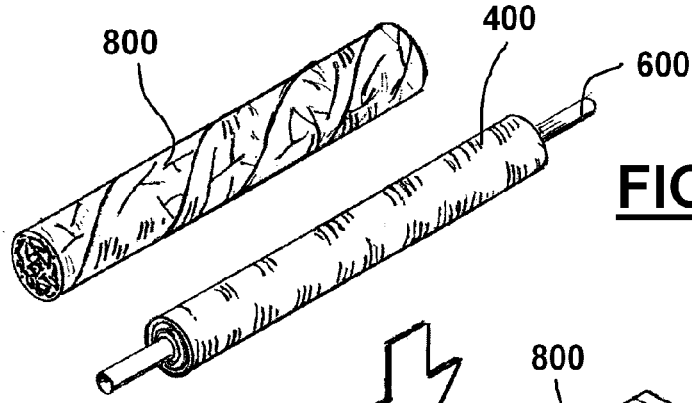
FIGS. 16 and 17 show one embodiment of a kit of including a finished tobacco product (cigar) and a pre-rolled sheet on a form casing.
Figure 17:
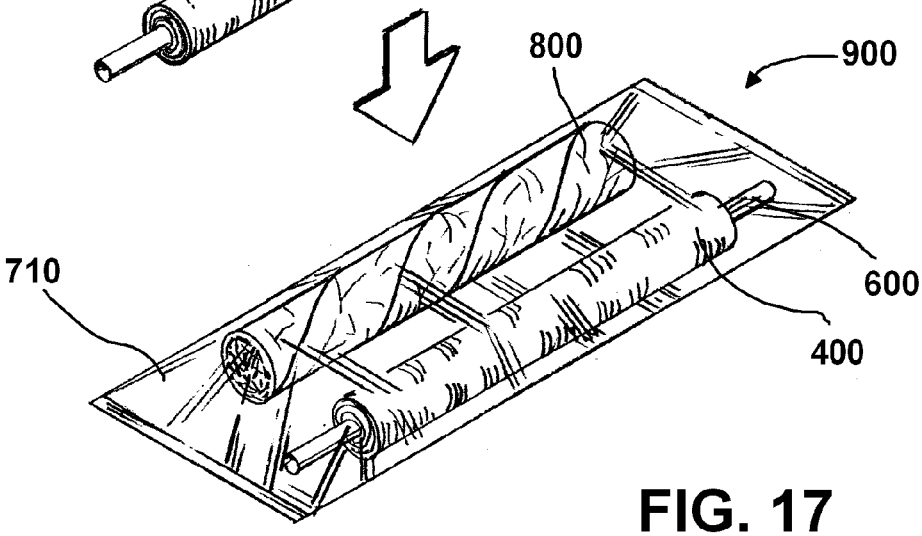

FIGS. 16 and 17 show one embodiment of a kit 900 including a finished tobacco product 800 (cigar) located adjacent a pre-rolled sheet 400 on a form casing 600, and kit 900 is packaged in packaging 710.

Figure 18:
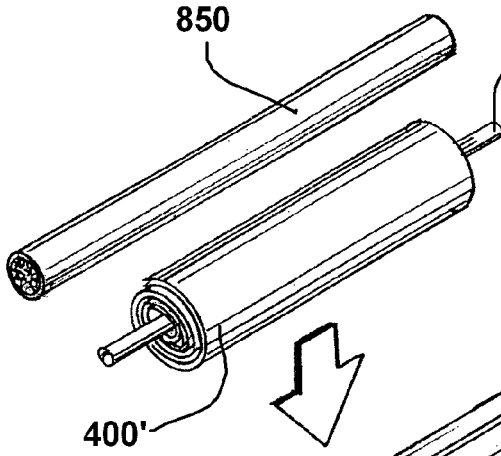
FIGS. 18 and 19 show one embodiment of a kit of including a finished tobacco product (cigarette) and multiple pre-rolled sheets on a form casing.
Figure 19:
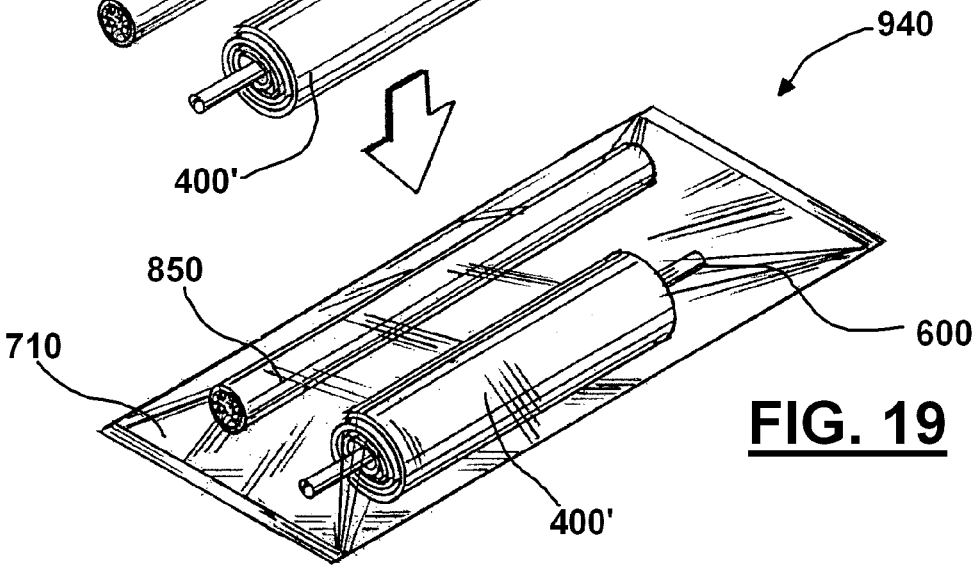

FIGS. 18 and 19 show one embodiment of a kit 940 including a finished tobacco product 850 (cigarette) located adjacent multiple pre-rolled sheets 400' on a form casing 600, and kit 940 is packaged in packaging 710.

Figure 20:
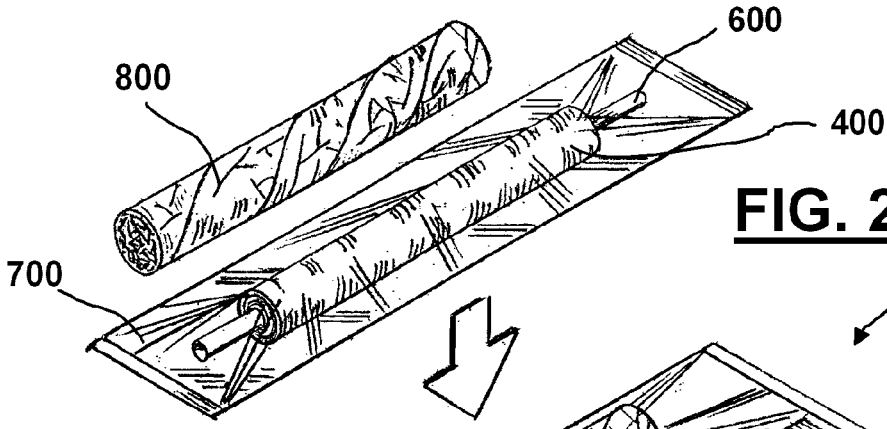
FIGS. 20 and 21 show one embodiment of a kit of including a finished tobacco product (cigar) and a pre-rolled sheet on a form casing where the pre-rolled sheet is individually packaged.
Figure 21:
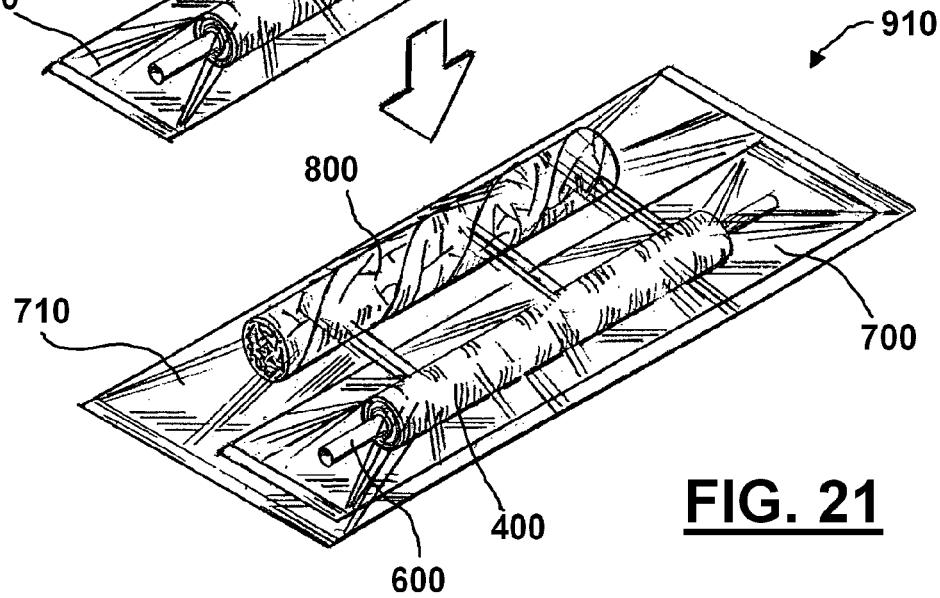

FIGS. 20 and 21 show one embodiment of a kit 910 including a finished tobacco product (cigar) located adjacent a pre-rolled sheet 400 on a form casing 600 where the pre-rolled sheet is individually packaged in package 700, and kit 910 is packaged in packaging 710.

Figure 22:
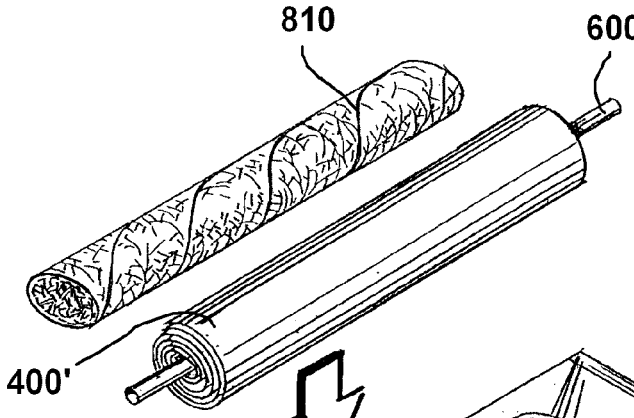
FIGS. 22 and 23 show one embodiment of a kit of including a finished tobacco product (cigar which is elliptically shaped) and multiple pre-rolled sheets on a form casing.
Figure 23:
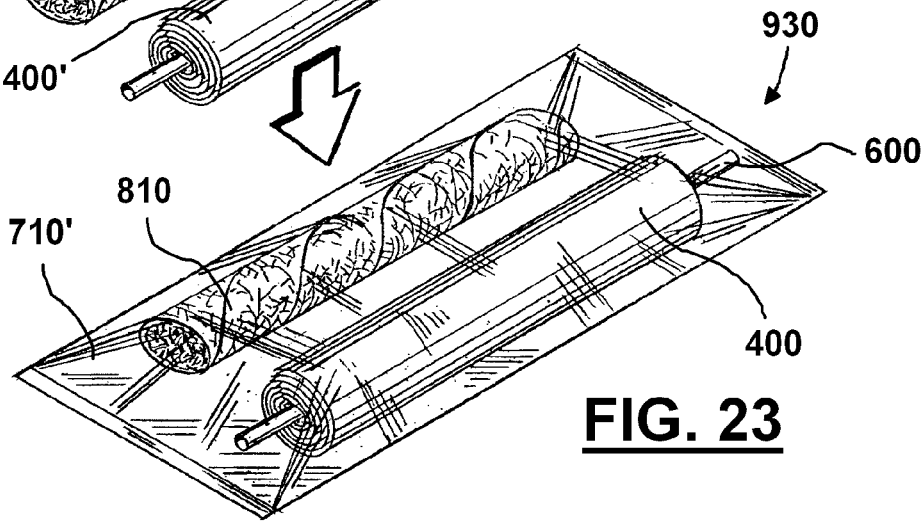

FIGS. 22 and 23 show one embodiment of a kit 930 including a finished tobacco product 810 (cigar which is elliptically shaped) located adjacent multiple pre-rolled sheets 400' on a form casing 600, and kit 930 packaged in packaging 710.

Figure 24:
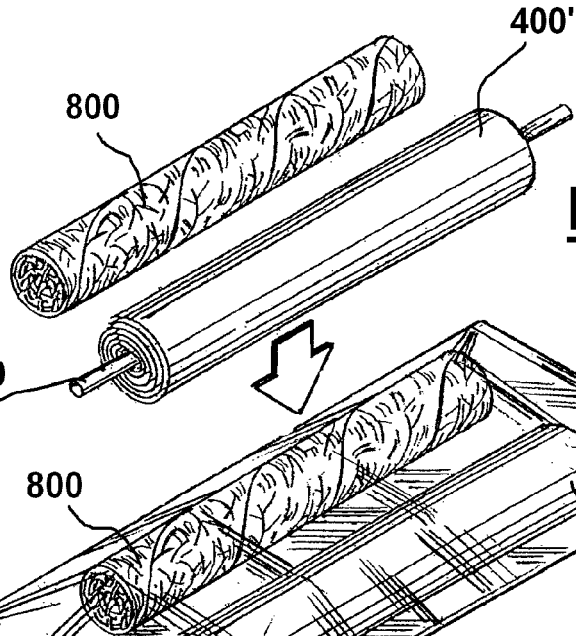
FIGS. 24 and 25 show one embodiment of a kit of including a finished tobacco product (cigar) and multiple pre-rolled sheets on a form casing.
Figure 25:
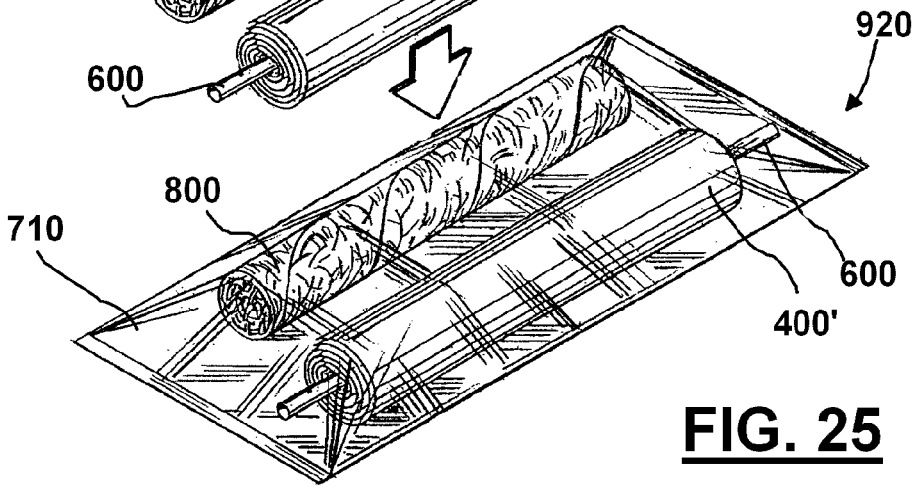

FIGS. 24 and 25 show one embodiment of a kit 920 including a finished tobacco product 800 (cigar) located adjacent multiple pre-rolled sheets 400' on a form casing 600 and kit 920 is and packaged in packaging 710.

Figure 26:
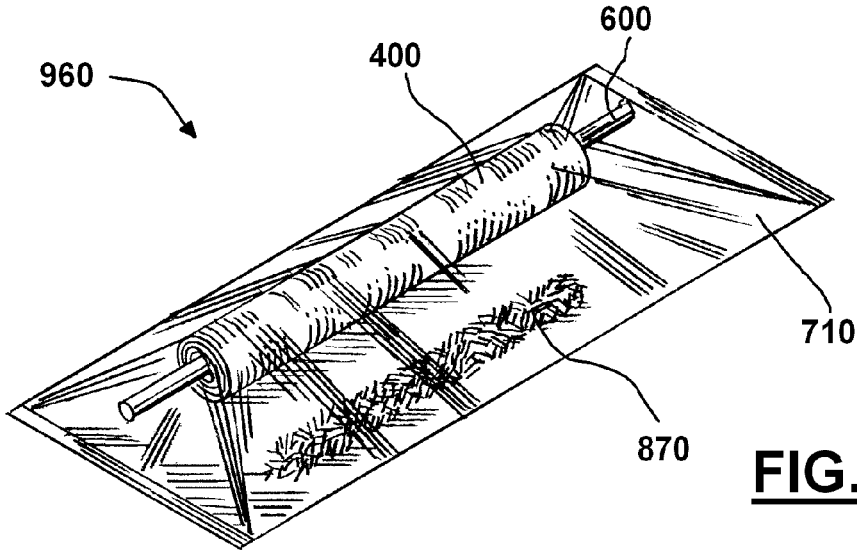
FIG. 26 shows one embodiment of a kit of including a pre-rolled sheet on a form casing along with tobacco filler material which can form a finished cigar.

FIG. 26 shows one embodiment of a kit 960 including a pre-rolled sheet 400 on a form casing 600 located adjacent tobacco filler material 870 which can form a finished cigar, and kit 960 packaged in packaging 710.

Figure 27:
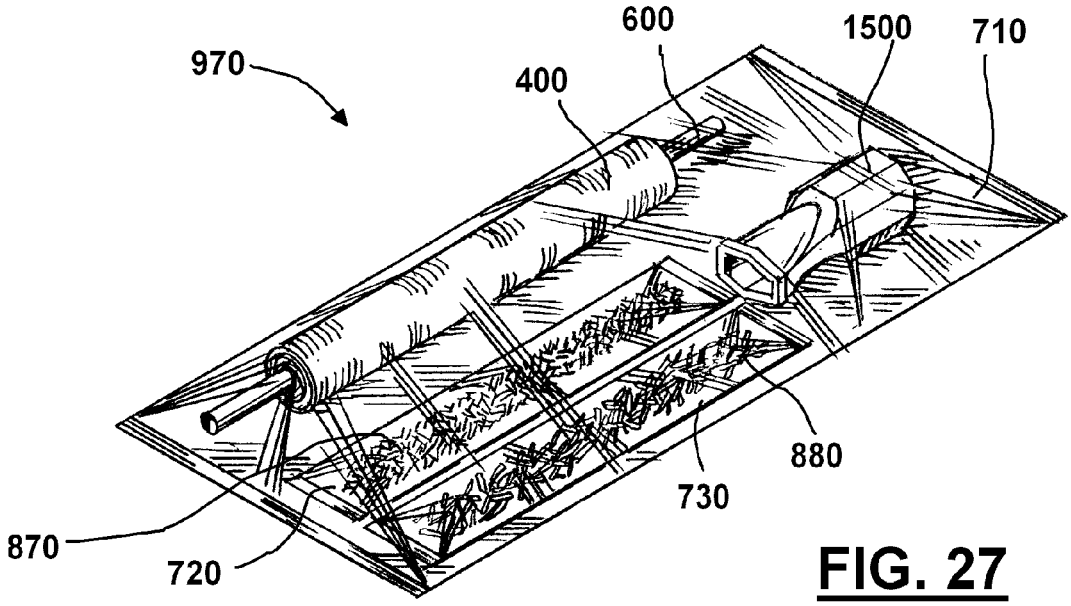
FIG. 27 shows one embodiment of a kit of including a pre-rolled sheet on a form casing, a plurality of choices of tobacco filler which can form a finished cigar, along with a tip.
Figure 28:
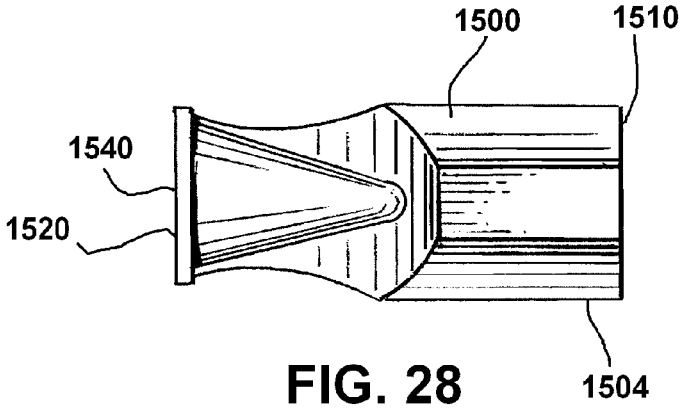
FIGS. 28 through 32 show one embodiment for a tip.
Figure 29:
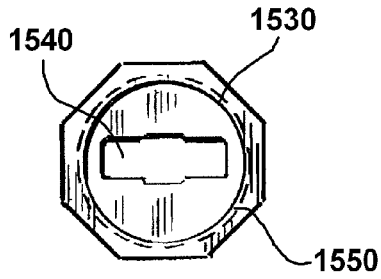
Figure 30:
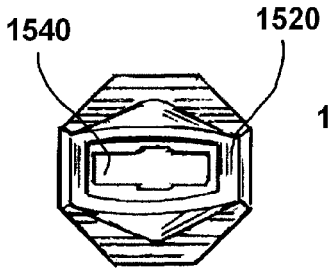
Figure 31:
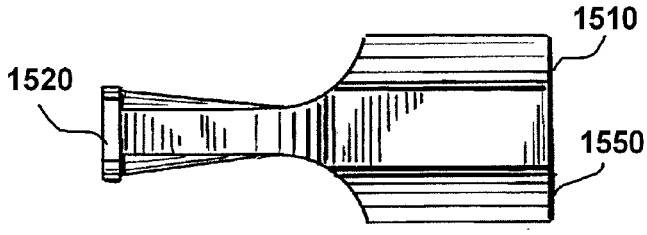

FIG. 27 shows one embodiment of a kit 970 including a pre-rolled sheet 400 on a form casing 600 located next to a plurality of choices of tobacco filler 870, 880, etc., which combination of sheet 400 and tobacco filler can form a finished tobacco product, along with a tip 1500, and kit 970 is packaged in packaging 710. In this embodiment, tobacco filler 870 and/or 880 can itself be individually packaged in packaging 720 and/or 730.

Although not expressly stated any of the embodiments shown in FIGS. 16 through 27 can use any of the form casings 600 disclosed in this application, any of the sheets 400, 400', etc. disclosed in this application, any of the filler material disclosed in this application, along with any of the cigar tips disclosed in this application. For example, kit 900 can also include multiple sheets, with intermediate sheets, with a casing having an intermediate filler, along with a cigar tip. These permutations although intended to be covered are not expressly laid out to make this application more concise.

FIGS. 28 through 32 show one embodiment for a tip 1500. Tip 1500 can comprise first end 1510, second end 1520, cigar opening 1530, rear opening 1566, mouth opening 1540, threads 1550, large opening 1562, cross sectional area 1564. In all embodiments threads 1550 can go from first end 1510 to rear opening 1566. In various embodiments the threads can stop short of rear opening 1566.

Figure 33:
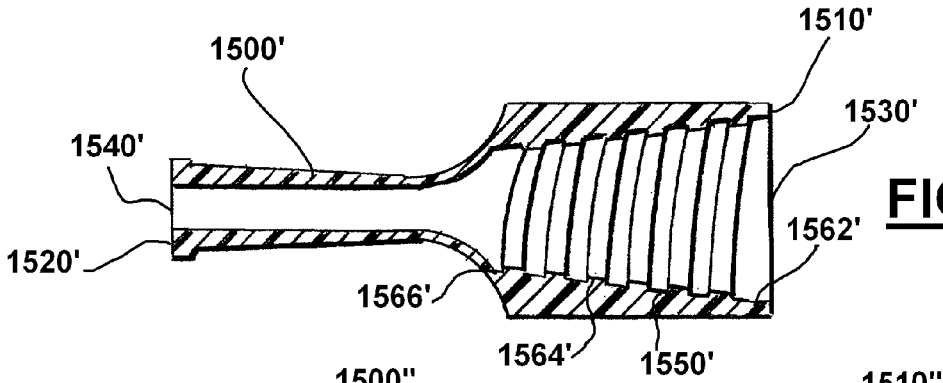
FIGS. 33 and 34 show alternative embodiments for the tip of FIG. 28.
Figure 34:
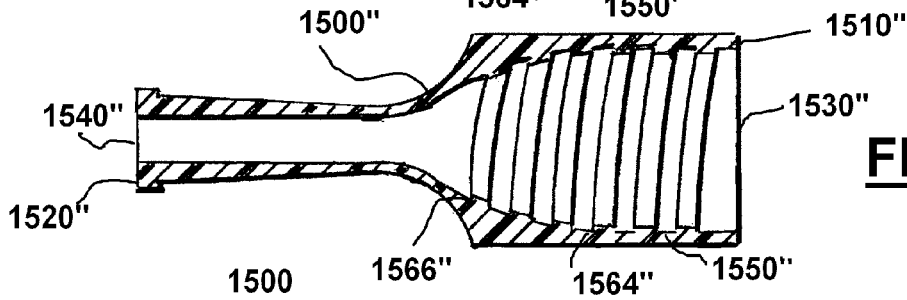
Figure 32:
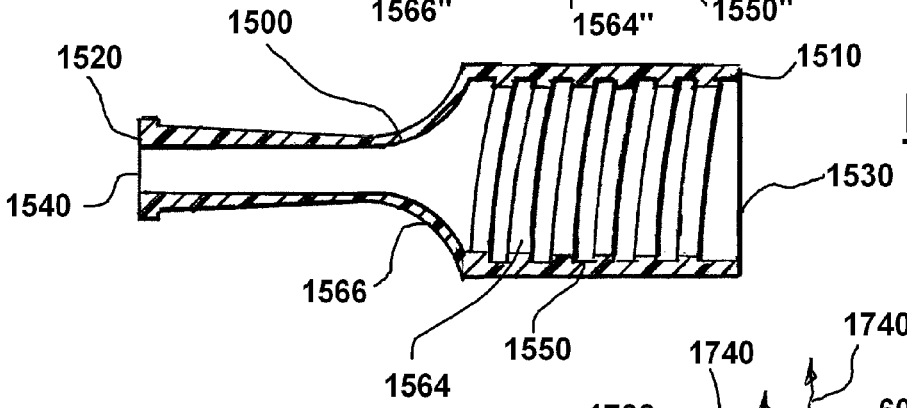

FIGS. 33 and 34 provide alternative embodiments for the interior of tip 1500. In FIG. 33 is shown a tapered threaded area 1564' having threads 1550'. In FIG. 34 is shown a parabolic threaded area 1564" having threads 1550".

Figure 35:
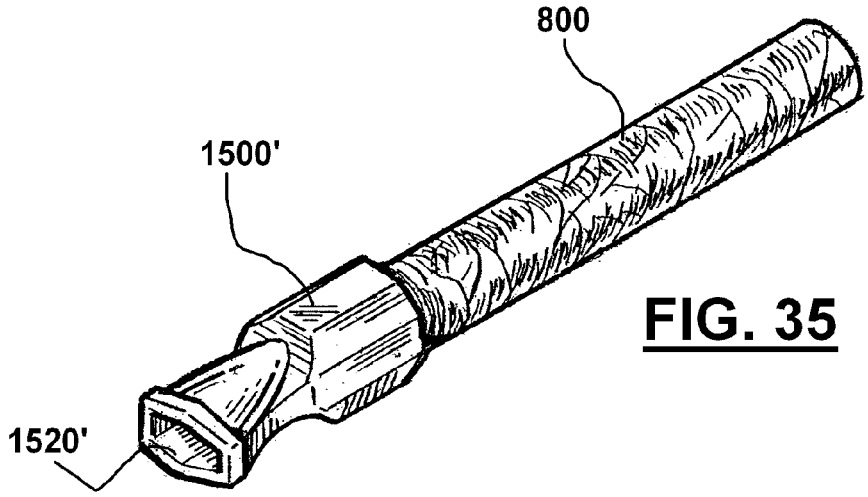
FIGS. 35 and 36 show the tip of FIG. 28 affixed to a cigar.
Figure 36:
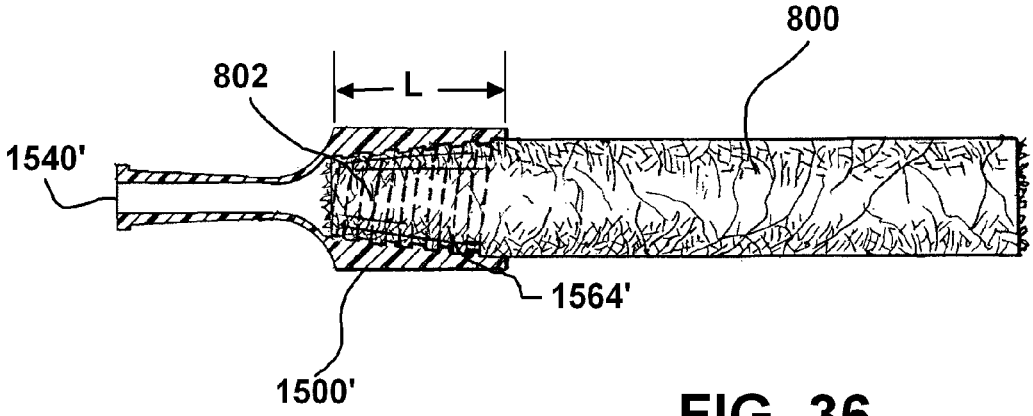

FIGS. 35 and 36 show tip 1500' attached to a cigar 800. Rear portion 802 of cigar 800 is threadably attached to tip 1500' via threads 1564'.

Figure 37:
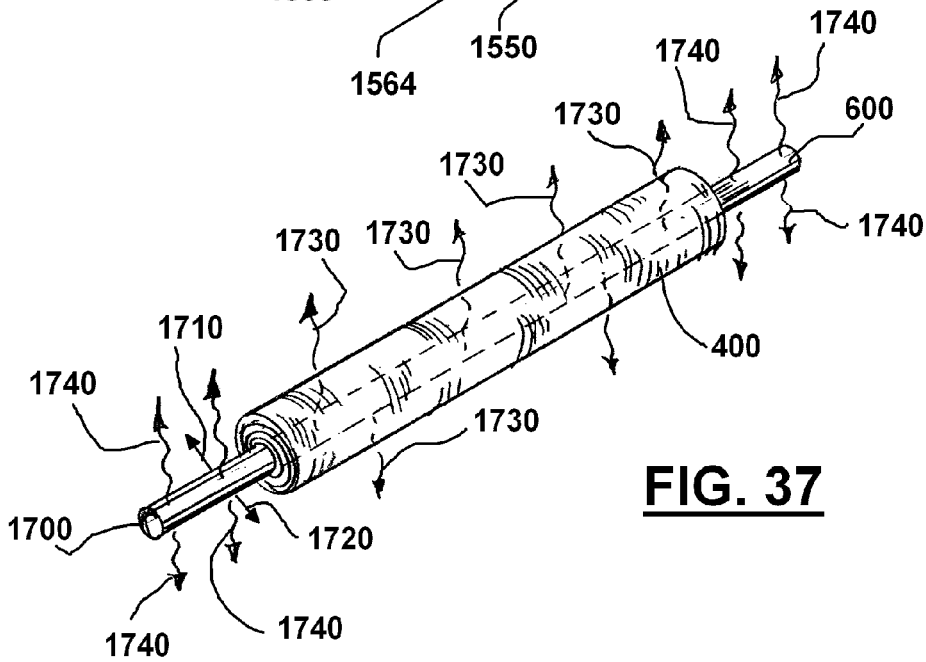
FIG. 37 shows an alternative embodiment of a set of pre-rolled sheet(s) on a form casing where the form casing comprises a material which tends to support migration of a substance such as moisture, tastes, and/or scent or contains such material and facilitates such migration.

FIG. 37 shows an alternative embodiment of a set of pre-rolled sheet(s) 400 on a form casing 600 where the form casing 600 comprises a material 1700 which tends to support migration of a substance such as moisture, tastes, and/or scent or contains such material 1700 and facilitates such migration. Form casing can include material 1700. Arrows 1710 and 1720 indicate the direction of migration of moisture, taste, and/or scent. Plurality of migration waves 1730, 1740 schematically indicate such migration. In this manner form casing 1700 can be used to moisturize, scent, and/or flavor set of pre-rolled sheet(s).

REFERENCE NUMERAL LIST

| REFERENCE NO. | DESCRIPTION |
|---|---|
| 100 | sheet |
| 110 | edge |
| 120 | edge |
| 130 | edge |
| 140 | edge |
| 150 | first end |
| 160 | second end |
| 170 | longitudinal opening |
| 200 | sheet |
| 210 | edge |
| 220 | edge |
| 230 | edge |
| 240 | edge |
| 250 | first end |
| 260 | second end |
| 270 | longitudinal opening |
| 300 | sheet |
| 310 | edge |
| 320 | edge |
| 330 | edge |
| 340 | edge |
| 350 | first end |
| 360 | second end |
| 370 | longitudinal opening |
| 400 | one or more pre-rolled sheet(s) |
| 410 | longitudinal opening |
| 430 | arrows |
| 432 | arrows |
| 500 | separating sheet |
| 510 | separating sheet |
| 520 | separating sheet |
| 600 | form casing |
| 700 | packaging |
| 710 | packaging |
| 720 | packaging |
| 730 | packaging |
| 800 | finished cigar |
| 810 | finished cigar of oval shape |
| 850 | finished cigarette |
| 870 | tobacco filler |
| 880 | tobacco filler |
| 900 | kit |
| 910 | kit |
| 920 | kit |
| 930 | kit |
| 940 | kit |
| 950 | kit |
| 960 | kit |
| 970 | kit |
| 1020 | non-smokable form casing |
| 1030 | tobacco filler material |
| 1040 | tobacco filler materialy |
| 1050 | sheet |
| 1060 | bore |
| 1070 | perforations |
| 1080 | edge |
| 1090 | edge |
| 1100 | arrow |
| 1110 | arrow |
| 1120 | arrow |
| 1130 | arrow |
| 1140 | line |
| 1150 | perforations |
| 1200 | non-smokable form casing |
| 1210 | sheet |
| 1220 | edge |
| 1230 | edge |
| 1240 | openings |
| 1250 | openings |
| 1260 | arrow |
| 1270 | arrow |
| 1280 | cord/string/thread/tie |
| 1300 | non-smokable form casing |
| 1310 | sheet |
| 1320 | edge |
| 1330 | edge |

-continued

REFERENCE NUMERAL LIST

| REFERENCE NO. | DESCRIPTION |
|---|---|
| 1340 | area |
| 1350 | edge |
| 1360 | edge |
| 1500 | tip |
| 1510 | first end |
| 1520 | second end |
| 1530 | large opening |
| 1540 | mouth opening |
| 1550 | threads |
| 1560 | opening |
| 1564 | cross sectional area |
| 1566 | rear opening |
| 1700 | material |
| 1710 | arrow |
| 1720 | arrow |
| 1730 | plurality of migration waves |
| 1740 | plurality of migration waves |
| 1750 | plurality of migration waves |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A tobacco kit comprising:

(a) a finished tobacco product;

(b) a first pre-rolled sheet;

(c) a form casing supporting the first-rolled sheet in a rolled condition, the form casing including a gel interior and a perforated section, the gel being a moisturizing material which moisturizes the first pre-rolled sheet;

(d) the finished tobacco product being placed adjacent the first pre-rolled sheet and form casing; and (e) the finished tobacco product and first pre-rolled sheet being packaged together in a side-by-side condition.

2. The tobacco kit of claim 1, wherein the finished tobacco product is a cigarette.

3. The tobacco kit of claim 1, wherein the finished tobacco product is a cigar.

4. The tobacco kit of claim 1, wherein the form casing also imparts scent to the first pre-rolled sheet.

5. The tobacco kit of claim 1, further including a cigar tip packaged together with the finished tobacco product and first pre-rolled sheet.

6. The tobacco kit of claim 1, further including a second pre-rolled sheet, the form casing supporting both the first and second pre-rolled sheets in a rolled condition.

7. The tobacco kit of claim 1, wherein the form casing also imparts flavor to the first pre-rolled sheet.

8. The tobacco kit of claim 1, wherein the form casing contains an outer non-smokable material containing an inner core of tobacco filler material.

9. The tobacco kit of claim 6, where in the second pre-rolled sheet serves as a separating sheet which tends to resist sticking together of the first pre-rolled sheet when the first pre-rolled sheet is in a rolled condition.

10. The tobacco kit of claim 6, further including a third sheet which is rolled in between the first and second pre-rolled sheets and serves as a separating sheet which tends to resist sticking together of the first and second pre-rolled sheets when the first and second pre-rolled sheet are in a rolled condition.

11. The tobacco kit of claim 6, wherein the first pre-rolled sheet is of a first material and the second pre-rolled sheet is of a second material.

12. The tobacco kit of claim 6, wherein the first pre-rolled sheet is of a first flavor and the second pre-rolled sheet is of a second flavor.

13. The tobacco kit of claim 6, wherein the first pre-rolled sheet is of a first scent and the second pre-rolled sheet is of a second scent.

* * * * *